US005725127A

United States Patent [19]

Steinel

[11] Patent Number: 5,725,127

[45] Date of Patent: Mar. 10, 1998

[54] DEVICE FOR MELTING AND DISPENSING METERED AMOUNTS OF THERMOPLASTIC ADHESIVE

[75] Inventor: Heinrich Wolfgang Steinel, Bad Worishofen, Germany

[73] Assignee: Steinel GmbH & Co. KG, Herzebrock-Clarholz, Germany

[21] Appl. No.: 506,513

[22] Filed: Jul. 24, 1995

[30] Foreign Application Priority Data

Aug. 2, 1994 [DE] Germany ..... 94 12 462.0

[51] Int. Cl.[6] ..... B67D 5/62

[52] U.S. Cl. ..... 222/146.5

[58] Field of Search ..... 222/146.5

[56] References Cited

U.S. PATENT DOCUMENTS

| | | | |
|---|---|---|---|
| 4,317,529 | 3/1982 | Leibhard | 222/146.5 |
| 4,352,442 | 10/1982 | Leibhard et al. | 222/146.5 |
| 4,457,457 | 7/1984 | Dziki | 222/146.5 |
| 4,642,158 | 2/1987 | Steinel et al. | 222/146.5 X |
| 4,706,852 | 11/1987 | Borst et al. | 222/146.5 X |
| 4,804,110 | 2/1989 | Sperry et al. | 222/146.5 X |

FOREIGN PATENT DOCUMENTS

| | | |
|---|---|---|
| 0 205 329 | 12/1986 | European Pat. Off. . |
| 0 423 388 | 4/1991 | European Pat. Off. . |
| 2 364 699 | 4/1978 | France . |
| 2 028 687 | 3/1980 | United Kingdom . |
| 2 032 303 | 5/1980 | United Kingdom . |

*Primary Examiner*—Kenneth Bomberg
*Attorney, Agent, or Firm*—Darby & Darby

[57] ABSTRACT

The present invention refers to a device for melting and dispensing metered amounts of thermoplastic adhesive, having a heatable melting chamber, having a connecting sleeve formed at the entry side of the melting chamber, and a sealing collar, having a through opening in the axial direction, through which the adhesive can be inserted into the melting chamber. The sealing collar is composed of two pieces, a heat-proof first part and a resilient second part, wherein the resilient part is enclosed by a first part in an overlapping region and the first part is mounted onto the connecting sleeve.

9 Claims, 1 Drawing Sheet

DEVICE FOR MELTING AND DISPENSING METERED AMOUNTS OF THERMOPLASTIC ADHESIVE

FIELD OF THE INVENTION

The present invention refers to a device for melting and dispensing metered amounts of thermoplastic adhesives.

A device of this kind is used e.g. for hot sealing pistols, which have been widely used during the last years. In such a hot melting pistol, a rod made of a thermoplastic adhesive, which is solid at room temperature, is inserted in a mechanically or electrically operable feed device into a heatable melting chamber. The thermoplastic adhesive melts in the melting chamber at a predetermined temperature and becomes liquid. Due to the pressure of the adhesive which follows, the liquid adhesive is pressed out of an opening in the housing of the hot melting pistol and can be applied at a suitable position of the workpiece to be bonded.

An essential problem of hot melting pistols of this kind is the sealing of the melting chamber. To prevent leaking of the liquid adhesive out of the rear end of the melting chamber, it is common to provide a sealing collar at this position. Resilient material, such as silicon rubber, was formerly used for the sealing collar. The sealing collar is formed tubularly and comprises a radially outwardly projecting sealing lip. The sealing lip is located directly on a connecting sleeve provided at the heating chamber. At least the part of the sealing collar which is situated directly on the connecting sleeve is heated severely during operation, which leads to the result that the sealing collar loses its resilient properties and becomes hard and brittle, so that it does either not seal the melting chamber satisfactorily or that the sealing collar comes off the connecting sleeve.

BRIEF DESCRIPTION OF THE INVENTION

The object of the invention is to provide a device for melting thermoplastic adhesive, which guarantees a good functionability even during long-lasting operations.

According to the present invention, this object is solved in that the sealing collar is composed of two pieces, consisting of a heat-proof first part and of a resilient second part. The resilient part is enclosed in an overlapping region by the first part and the first part is put on the connecting sleeve of the melting chamber in clamping fashion. The resilient part is thus not directly connected to the melting chamber, as is the case in conventional devices, but is retained by the first heat-proof part. Thus, the heating of the resilient part during operation of the device is less than in a conventional device, whereby the sealing function of the collar and the connection to the heating chamber is maintained for a long time.

In a preferred embodiment of the device, a sealing ring is arranged between the connecting sleeve and the first part of the sealing collar, said sealing ring being retained in form-fit fashion in an appropriate annular groove in the inner wall of the first part. A sealing ring of this kind additionally serves for sealing and for a further improvement of the clamp seat of the sealing collar on the connecting sleeve.

Preferrably, the sealing ring is made of polytetrafluorethylene (TEFLON), which is a very heat-proof and resistant material.

According to a preferred embodiment of the device, the resilient second part has a bead along its outer periphery, which engages an appropriately shaped groove in the inner wall of the first part of the sealing collar. Thereby, a very tight connection between both parts of the sealing collar is achieved, wherein the mounting process is also very simple. The resilient part only has to be inserted into the second part, until the bead locks into the annular groove. If an adhesive is to be inserted into the sealing collar, a mutual displacement of the two parts of the sealing collar is impossible. This is in particular important, since in a hot melting pistol the adhesive rod is changed quite often, which requires that the two parts have to be secured against displacement during tensile load as well as pressure load.

The first part of the sealing collar preferrably consists of a polyphenylene sulphide, also known by the brand name RYTON. Such a material has an excellent heat resistance, a low temperature coefficient of expansion and a high strength.

In a further advantageous embodiment of the device, the second part of the sealing collar has a radially inwardly projecting sealing ring at the end facing the connecting sleeve, wherein the front side of the second part abuts the front side of the connecting sleeve. The inwardly projecting sealing ring improves the sealing of the melting chamber and holds back possibly existing dust particles at the surface of the adhesive rod, so that these dust particles cannot penetrate into the melting chamber. Since the front side of the second part abuts the front side of the connecting sleeve, the heat coupling between the melting chamber and the resilient second part is very small, which further reduces the heating of the resilient part.

Finally, it is of advantage, if the cross section of the first part diminishes in the opposite direction of the insertion direction of the adhesive. This leads to a drop of temperature in the first part, starting from the end with the larger cross section to the other end with the smaller cross section. The heat coupling between the first and the second part of the sealing collar is also lowered by this measure.

BRIEF DESCRIPTION OF THE DRAWINGS

The invention will now be described by the aid of the drawings.

DETAILED DESCRIPTION OF THE INVENTION

Figure 1:
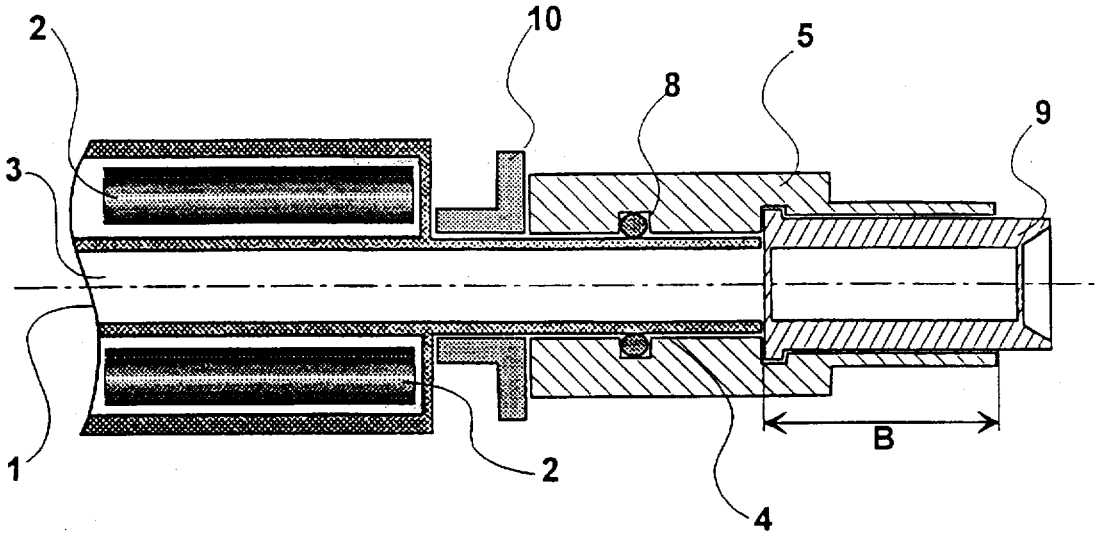
FIG. 1 is a longitudinal section through a part of the melting chamber and the attached sealing collar and FIG. 2 is a magnified view of a longitudinal section of the first part of the sealing collar.

FIG. 1 shows the rear part of the melting chamber 1 of a hot melting pistol having two heating elements 2, disposed on opposite sides of the melting channel 3. The melting channel extends in the axial direction in form of a connecting sleeve 4, which is integrally formed with the melting chamber 1. During operation of the hot melting pistol, an adhesive rod made of a thermoplastic material is inserted into the melting chamber. The adhesive becomes liquid if the melting chamber has a sufficiently high temperature.

The sealing collar according to the invention has a heat-proof first part 5, which is clamped onto a connecting sleeve 4. The first part 5 has an essentially hollow-cylindrical shape, having in an illustrative example a length of approximately 35 mm and an outer diameter of 24 mm and an inner diameter of 15.4 mm at the side which faces the melting chamber. The outer diameter at the other side opposite the melting chamber is 20.2 mm and the inner diameter is 18.2 mm. Polyethylene sulphide resin (brand name Ryton®) has turned out to be excellent as the material for the first part 5 of the sealing collar, since this material has a low heat coefficient of expansion and is indifferent to temperatures of up to 200° C. Two annular grooves 6, 7, having in an illustrative example a width of 3 to 3.5 mm, are formed at the inner wall of the first part 5 of the sealing collar, as can be clearly derived from FIG. 2. A sealing ring 8 is retained in form-fit fashion in the first annular groove. The depth of the annular groove 6 and the diameter of the sealing ring 8 retained therein is chosen so that in assembled condition of the device, the first part 5 is clamped to the connecting sleeve 4.

Figure 2:
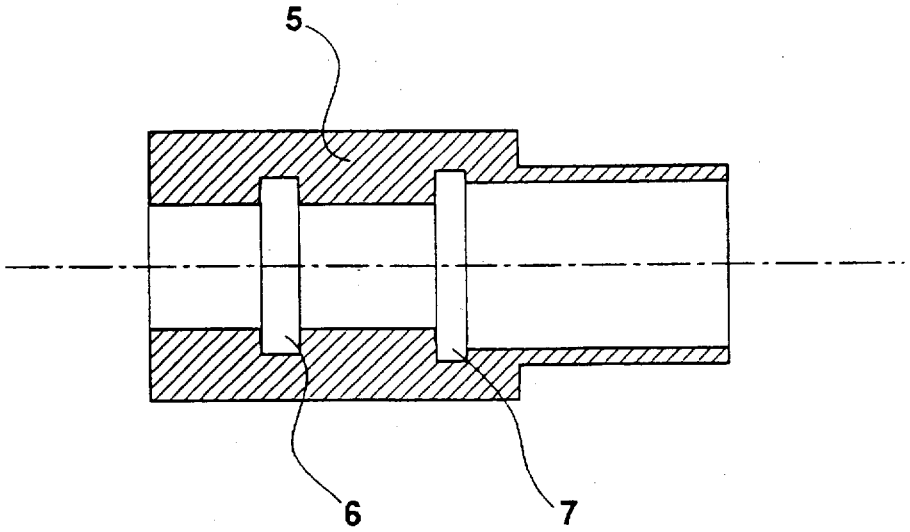

The resilient second part 9, which is enclosed by the first part in an overlapping region B, comprises an annular bead along the outer periphery thereof, said bead being retained in form-fit fashion within the second annular groove 7 (FIG. 2). A radially inwardly projecting sealing ring is disposed at the end of the second part 9, which faces the connecting sleeve around the inner periphery thereof. This sealing ring improves the sealing of the melting chamber to prevent liquid adhesive from exiting the melting chamber and reaching the housing. The second part 9 of the sealing collar e.g. is silicon rubber, however, it is possible to use different kinds of rubber or resilient plastic materials.

To achieve a possibly low heat coupling between the heating elements 2 or the melting chamber 1 and the sealing collar 5, 9, a seal or insulation ring 10 can additionally be put onto the connecting sleeve of the melting chamber. The part 5 has a cross section, which diminishes towards the rear direction, i.e. opposite to the insertion direction of an adhesive, which is an additional measure to avoid the heating of the resilient second part 9 (FIG. 2). The smaller the cross section of the first part 5, the smaller the transfer of heat to the second part 9. In the embodiment shown in the Figures, the cross section of the first part 5 is greater in the region which is put onto the connecting sleeve and approximately half of the overlapping region with the second part 9, in order to achieve a sufficient mechanical strengt. The remaining half of the overlapping region 9 in contrast has a smaller diameter. Hence, the heating of the second part is less during operation of the device, which leads to a longer life of the device.

I claim:

1. Device for melting and dispensing metered amounts of thermoplastic adhesive, comprising:

a heatable melting chamber having a connecting sleeve formed at an entry side thereof;

a sealing collar having a through opening in an axial direction through which the adhesive can be inserted into the melting chamber, said sealing collar comprising a heat-proof first part and a resilient second part that is enclosed in an overlapping region by said first part, said first part mounted onto said connecting sleeve; and a sealing ring between said connecting sleeve and said first part of said sealing collar, said sealing ring being retained within an annular groove of an inner wall of said first part.

2. A device according to claim 1 wherein said sealing ring is of polytetrafluorethylene.

3. A device according to claim 1, wherein said resilient second part further comprises a bead along an outer periphery thereof which engages into a groove in the inner wall of said first part of said sealing collar.

4. A device according to claim 3, wherein said second part of said sealing collar further comprises a radially inwardly projecting sealing ring at an end thereof facing said connecting sleeve, a front side of said second part abutting a front side of said connecting sleeve.

5. A device according to claim 4, wherein a cross section of said first part diminishes in a direction towards an insertion direction of the adhesive into the entry side of said melting chamber.

6. A device according to claim 1, wherein said second part of said sealing collar is made of a resilient material.

7. A device according to claim 1, wherein said first part of said sealing collar is made of polyphenylene sulphide material (PPF-resin).

8. A device according to claim 1, wherein said second part of said sealing collar further comprises a radially inwardly projecting sealing ring at an end thereof facing said connecting sleeve, and a front side of said second part abutting a front side of said connecting sleeve.

9. A device according to claim 1, wherein a cross section of said first part diminishes in a direction towards an insertion direction of the adhesive into the entry side of said melting chamber.

* * * * *

UNITED STATES PATENT AND TRADEMARK OFFICE

CERTIFICATE OF CORRECTION

PATENT NO. : 5,725,127

DATED : March 10, 1998

INVENTOR(S) : Heinrich Wolfgang STEINEL

It is certified that error appears in the above-indentified patent and that said Letters Patent is hereby corrected as shown below:

Title page, item [30], foreign Application Priority Data, change "94 12 462.0" to --G 94 12 462.0--.

Signed and Sealed this

Twenty-eighth Day of September, 1999

*Attest:*

Q. TODD DICKINSON

*Attesting Officer*

*Acting Commissioner of Patents and Trademarks*